US007476794B2

(12) United States Patent
May, Jr.

(10) Patent No.: US 7,476,794 B2
(45) Date of Patent: Jan. 13, 2009

(54) SOUND MODIFICATION SYSTEM

(75) Inventor: James H. May, Jr., Palmdale, CA (US)

(73) Assignee: Remo, Inc., Valencia, CA (US)

( * ) Notice: Subject to any disclaimer, the term of this patent is extended or adjusted under 35 U.S.C. 154(b) by 360 days.

(21) Appl. No.: 11/223,292

(22) Filed: Sep. 12, 2005

(65) Prior Publication Data

US 2007/0056428 A1 Mar. 15, 2007

(51) Int. Cl.
*G10D 13/02* (2006.01)

(52) U.S. Cl. ..... 84/411 R

(58) Field of Classification Search ..... 84/411 R, 84/421, 411 A, 411 M

See application file for complete search history.

(56) References Cited

U.S. PATENT DOCUMENTS 6,518,490 B2 * 2/2003 Good ..... 84/414
7,214,867 B1 * 5/2007 Gatzen et al. ..... 84/411 R
2003/0029301 A1 * 2/2003 Belli ..... 84/411 R

* cited by examiner

*Primary Examiner*—Kimberly R Lockett
(74) *Attorney, Agent, or Firm*—Rapkin Gitlin Beaumont; Larry F. Gitlin

(57) ABSTRACT

A sound modification system for a musical drum comprising a drumshell, a drumhead with an inner surface and a playing surface, and one or more mounting members adapted to be mounted to the drumhead. Each mounting member includes a first coupling member, which is fixed to the drumhead and projects outwardly from the playing surface, and a second coupling member matable to said first coupling member. Also provided is a sound altering element, which is adapted to removably engage the playing surface of the drumhead and has means cooperable with the matable first and second coupling members to form a detachable connection between the sound altering element and the drumhead. The preferred embodiment of the present invention includes a sound altering means in a hoop-like or ring configuration having a plurality of openings formed at regular intervals therein and means inserted through each of the openings to snap-fasten the sound altering means to the playing surface of the drumhead.

16 Claims, 9 Drawing Sheets

SOUND MODIFICATION SYSTEM

BACKGROUND OF THE INVENTION

1. Field of the Invention

The present invention relates generally to the field of musical instruments. More particularly, the invention is directed to an improved system for reducing or enhancing certain sound characteristics of a drumhead.

2. Description of the Prior Art

Devices used for modifying the sound characteristics of drums and drumheads are well known in the prior art. Simple items, such as, for example, a simple piece of tape, patches, felt strips and a variety of Velcro® backed items have been used for this purpose. By placing a piece of tape, a patch, or the like, at some location on the drumhead, one can enhance or reduce the effect or intensity of the drum sounds, to achieve a particular objective. For example, a thin piece of tape can damper or "cut short" the sound produced by the head once it is struck. The heavier or more dense the item is that is placed on the head, the greater its dampening potential.

More complex devices are also used to dampen drum sounds, such as the device disclosed in U.S. Pat. No. 6,307,133 B1 to May, et al. This device is externally mounted and has the means to adjust the location of the dampening contact, or pad, the means to adjust the amount of pressure the pad exerts on the drumhead and the means to adjust the time interval ("gate time") the pad exists off the drumhead surface in response to an object striking the surface.

Examples of other systems in the prior art include U.S. Pat. No. 5,892,168 to Donohoe and U.S. Pat. No. 6,291,754 B1 to Gatzen, et al.

Donohoe discloses a muffling ring comprising a laminate of a flat annular ring for sound absorption backed by an elastic second annular ring-shaped lamination for urging the flat ring into contact with the drumhead. The sound absorbing ring is attached to the inner or non-battered surface of the membrane at regular intervals around the ring allowing for the unattached portions of the ring to "float" or move away from the membrane.

Gatzen discloses an externally mounted dampening system which includes a mounting fixture attached to the batter surface of the drumhead. Formed within the fixture is a channel for receiving dampening rings made of sound dampening materials. The disadvantage of this system is the need for the intrusive mounting fixture to maintain the dampening ring in close proximity to the batterhead. Another disadvantage is the limited capabilities of the system, which realistically can accommodate only a single dampening ring, and no additional dampening devices, to accomplish its objectives.

Accordingly, there is a need in the art to provide a sound modification system that is uncomplicated in structure, easy to install and can accommodate a variety of dampening devices to achieve different sounds, even in the course of playing the instrument.

ABSTRACT OF THE INVENTION

A sound modification system for a musical drum comprising a drumshell, a drumhead with an inner surface and a playing surface, and one or more mounting members adapted to be mounted to the drumhead. Each mounting member includes a first coupling member, which is fixed to the drumhead and projects outwardly from the playing surface, and a second coupling member matable to said first coupling member. Also provided is a sound altering element, which is adapted to removably engage the playing surface of the drumhead and has means cooperable with the matable first and second coupling members to form a detachable connection between the sound altering element and the drumhead. The preferred embodiment of the present invention includes a sound altering means in a hoop-like or ring configuration having a plurality of openings formed at regular intervals therein and means inserted through each of the openings to snap-fasten the sound altering means to the playing surface of the drumhead.

Accordingly, it is an object of the present invention to provide an improved sound modification system for a musical drum.

Still another object of the present invention is to provide an improved sound modification system for a musical drum that acts to reduce and enhance certain sound frequencies and characteristics.

Still another object of the present invention is to provide an improved sound modification system for a musical drum that acts to adjust the loudness of the drum sounds.

Still another object of the present invention is to provide an improved sound modification system for a musical drum that acts to reduce or enhance the decay characteristics in the drumhead.

Still another object of the present invention is to provide an improved sound modification system for a musical drum that acts to vent or close off volumes of air in the musical drum.

Still another object of the present invention is to provide an improved sound modification system for a musical drum that utilizes a sound altering element which is adapted to be removably mounted upon the playing surface of the drumhead.

Still another object of the present invention is to provide an improved sound modification system for a musical drum that utilizes matable snap fasteners to fasten the sound altering element to the playing surface of the drumhead.

Still another object of the present invention is to provide an improved sound modification system for a musical drum that enables the fastened sound altering element some flexibility of movement.

Still another object of the present invention is to provide an improved sound modification system for a musical drum that permits easy interchangeability of different types of sound altering elements.

Still another object of the present invention is to provide an improved sound modification system for a musical drum that is simple and uncomplicated for a musician to operate while playing the instrument.

Still another object of the present invention is to provide an improved sound modification system for a musical drum that is easy and cost effective to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
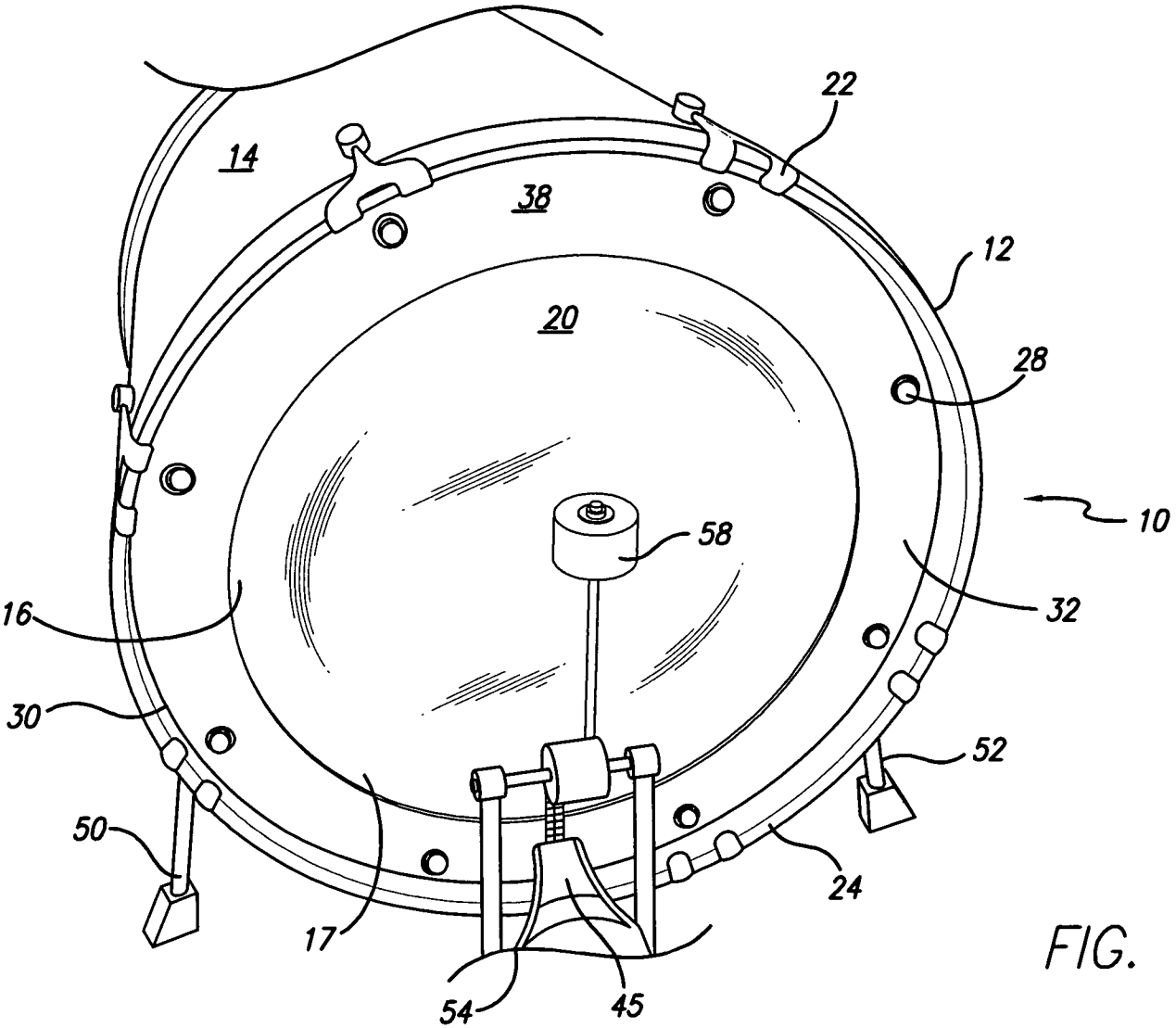
FIG. 1 is a perspective view of the improved sound modification system coupled to a bass drum in accordance with the present invention.
Figure 2A:
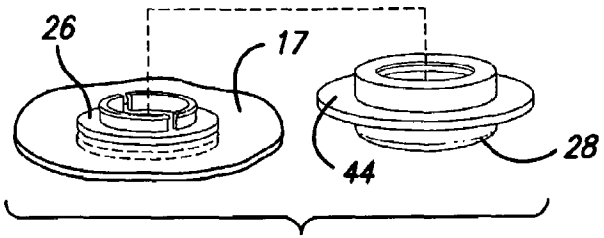
FIG. 2A is a perspective view of the components of the snap fastener in accordance with the present invention.
Figure 2B:
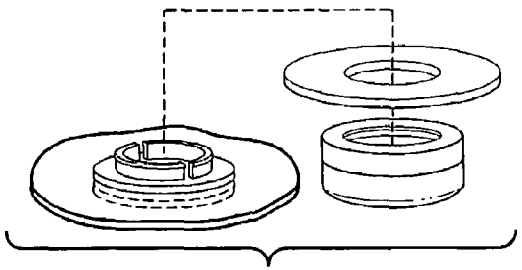
FIG. 2B is a perspective view of the components of an alternative embodiment of the snap fastener in accordance with the present invention.
Figure 2:
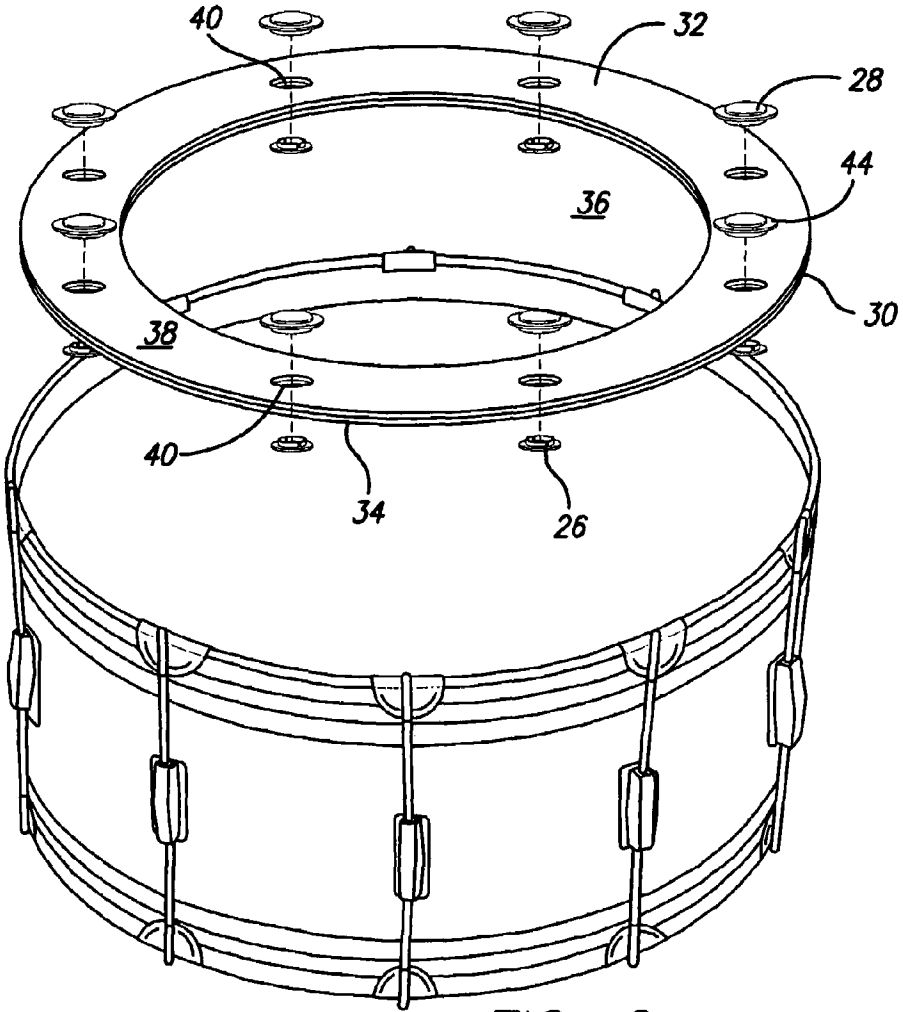
FIG. 2 is an exploded perspective view of the various elements of the improved sound modification system shown in FIG. 1 in accordance with the present invention.
Figure 3C:
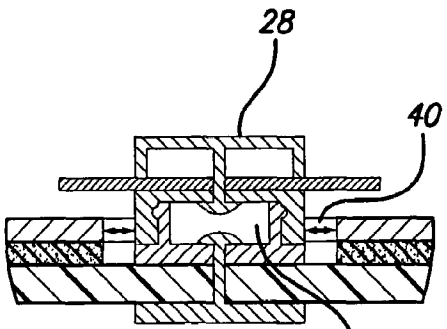
FIG. 3C is a cross-sectional view of the section shown encircled in FIG. 3*a*.
Figure 3B:
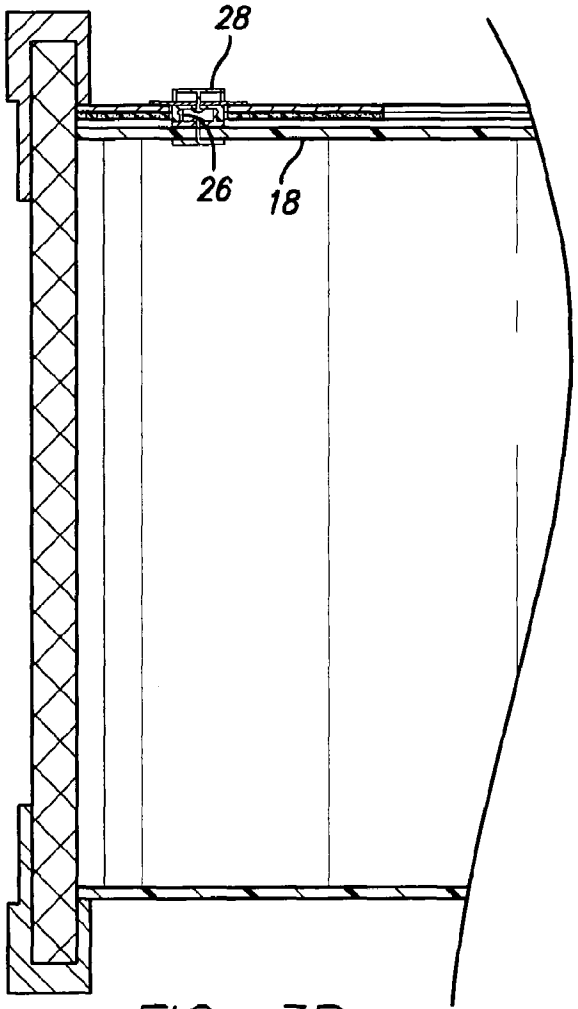
FIG. 3B is a cross-sectional view of the improved sound modification system coupled to a bass drum with the ring component shown floating (or separating from the membrane) in response to the drumhead being struck in accordance with the present invention.
Figure 3A:
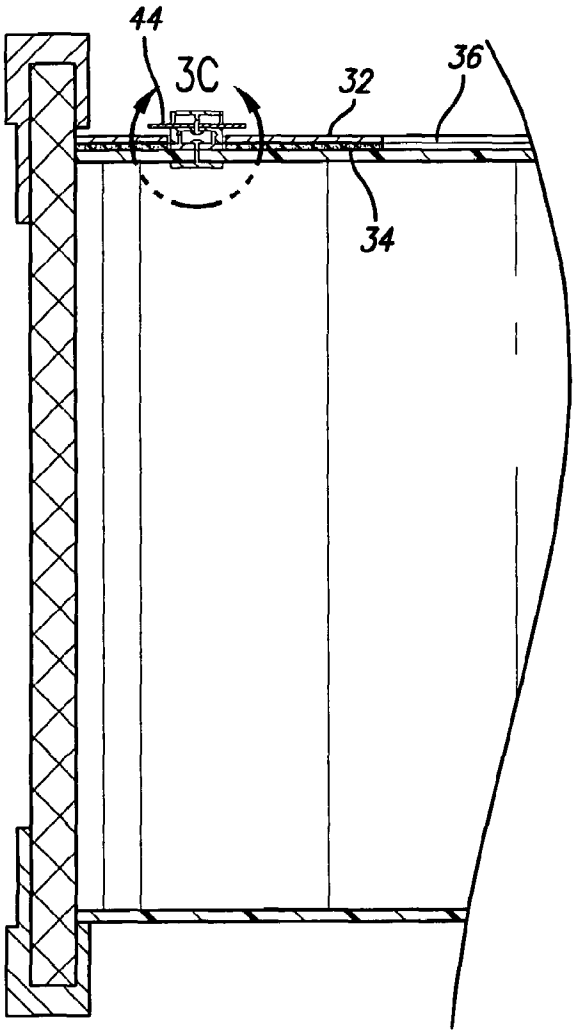
FIG. 3A is a cross-sectional view of the improved sound modification system coupled to a bass drum with the ring component shown at rest in accordance with the present invention.

The preferred embodiment of the present invention, as shown in FIGS. 1 and 2, provides a sound modification system designated generally as 10 comprised of a bass drum 12 having a drum shell 14, a drumhead 16 with an inner surface 18 and a playing surface 20, and drum lugs 22 to tension drumhead 16 and secure hoop 24 to drumshell 14.

Snap fastener 26 (also referred to as a "socket") is riveted or attached in any other suitable manner to playing surface 18. Matable with snap fastener 26 is snap fastener 28 (also referred to as a "button"). Fasteners 26 and 28 are typically made of a synthetic material, such as plastic, or any other suitably resilient material. Metal is also an alternative. Fastener 26, which begins as a rivet, is rolled over along its edges to effectively cinch and secure fastener 26 to drumhead membrane 17. Little or no air is lost (along the connection seam) as a result of this since fastener 26 is rolled and flared tightly against membrane 17. The average weight of fastener 26 is 0.3 grams, too little to restrict or alter the normal vibrations produced by the drumhead. Also, riveted fasteners, such as fastener 26, do not reduce the strength or related properties of the drumhead. Thus, the drumhead functions and sounds virtually the same, as if the riveted fasteners were not attached.

Snap fasteners 26 and 28 are provided to mount or partially suspend a dampening element, such as ring 30, respectively, towards or from playing surface 20. Ring 30 typically comprises a resilient polyester layer 32 and an attached felt or foam backing 34, though any suitable material or combination of materials with muting or dampening characteristics may be utilized for the purposes of the present invention. Other examples of suitable materials for this purpose, without limitation, include cloth or fleece. Ring 30 typically has about the same diameter as that of drumhead 16 and usually has an opening 36 in the center that varies in size depending upon factors unique to the instrument and/or to the needs or special playing style of the musician. The circumferential portion 38 of ring 30 that surrounds or borders opening 36 varies in width ranging from very narrow (e.g., ½ inch) to much wider (e.g. 3 or 4 inches or more). Circumferential portion 38 includes a plurality of openings 40 placed at regular intervals around ring 30. Each opening 40 is larger in diameter than the diameter of the individual fasteners 26 and 28 to enable ring 30 some space to move around a bit or "float" when mounted on drumhead 16. To prevent ring 30 from falling off or away from the drumhead, each fastener 28 is provided with a washer 44, usually, but not necessarily attached to fastener 28, which is larger than opening 40 and, thus, acts to assist in confining ring 30 close to the drumhead. Washer 44 may be comprised of any suitable resilient material.

Ring 30, which can be mounted to drumhead 16 from either side, though preferably on the side facing away from drum 12, acts to reduce and enhance certain sound frequencies emanating from the drum and adjust loudness, brightness and decay characteristics on the drumhead. Thus, the present invention has the ability to create new and unique drum sounds.

In typical practice, ring 30 is mounted on playing surface 20 by aligning each opening 40 with a corresponding snap fastener 26 riveted to surface 20. Snap fasteners 26 are mounted for mating with individually corresponding fasteners 28, which are inserted through each opening 40. Fasteners 28 are snap-fastened to fasteners 26 allowing ring 30 to be loosely held along the vertical plane of head 16 and be more flexible upon impact of an object on the drumhead. Opening 40 can, for example, have a diameter of ⅝ inch in, while snap fastener 28, more particularly washer 44, might have a diameter of ½ inch. Again, this permits the ring to have some play, i.e., room to maneuver with the ability to put a slight amount of pressure on head 16 upon impact on playing surface 20. Too much pressure on the head will result in an overly muffled undesirable drum sound.

As shown in FIG. 1, bass drum 12 includes support legs 50 and 52 and a pedal assembly 54, which, in turn, includes a foot pedal 45 and a mallet 58 pivotably operable by foot pedal 45 to strike drumhead 16. When drumhead 16 is struck it vibrates forcing air away from the head. These vibrations produce a certain sound, which may be sustained for up to 30 seconds or more, depending on a number of factors. Ring 30, when attached to head 16, creates new or different sounds produced by the head when a hard object, such as mallet 58, strikes it. Vibrations produced by the impacted head are either stifled, as a result of the contact with ring 30, or escape through the opening 36 in ring 30.

Figure 4:
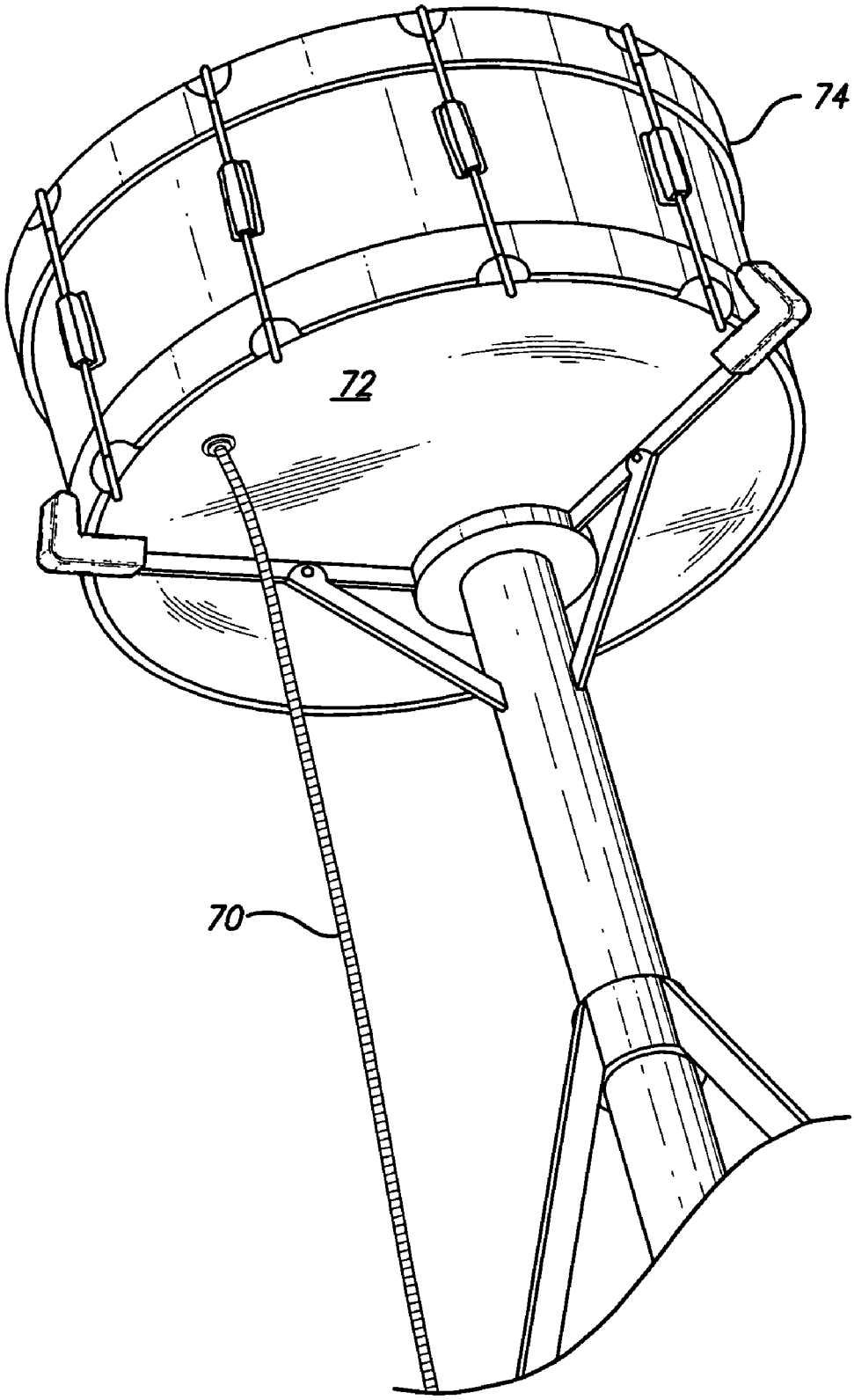
FIG. 4 is a perspective view of a first alternative embodiment of the improved sound modification system in accordance with the present invention.

Snap fasteners 26, 28 can be employed in other ways in accordance with the present invention. For example, a single socket or fastener 26, can be riveted to head 16 of any type of drum and mated with a button or fastener 28, which is attached to coil spring 70. In FIG. 4, wire-coiled spring 70, which is connected to snap fastener 28, is snap fastened to fastener 26, which is riveted or in some other appropriate manner attached to bottom head 72 of snare drum 74. When the top head of the snare drum (not shown) is struck, the vibrations are transferred through the head to spring 70, and then back and forth between the two, causing a reverberation of sound sustainable for various periods of time depending on the head size, the length of the spring and the strength and intensity of the initial impact on the head. Spring reverberation employed in this manner can be used in a variety of situations, including in live performances to enhance and adjust the sounds to make them more unique without the aid of microphones, midi sound devices, mixers, etc. This embodiment may also be used for sound effects or simply for creating new sounds for recording.

Figure 5:
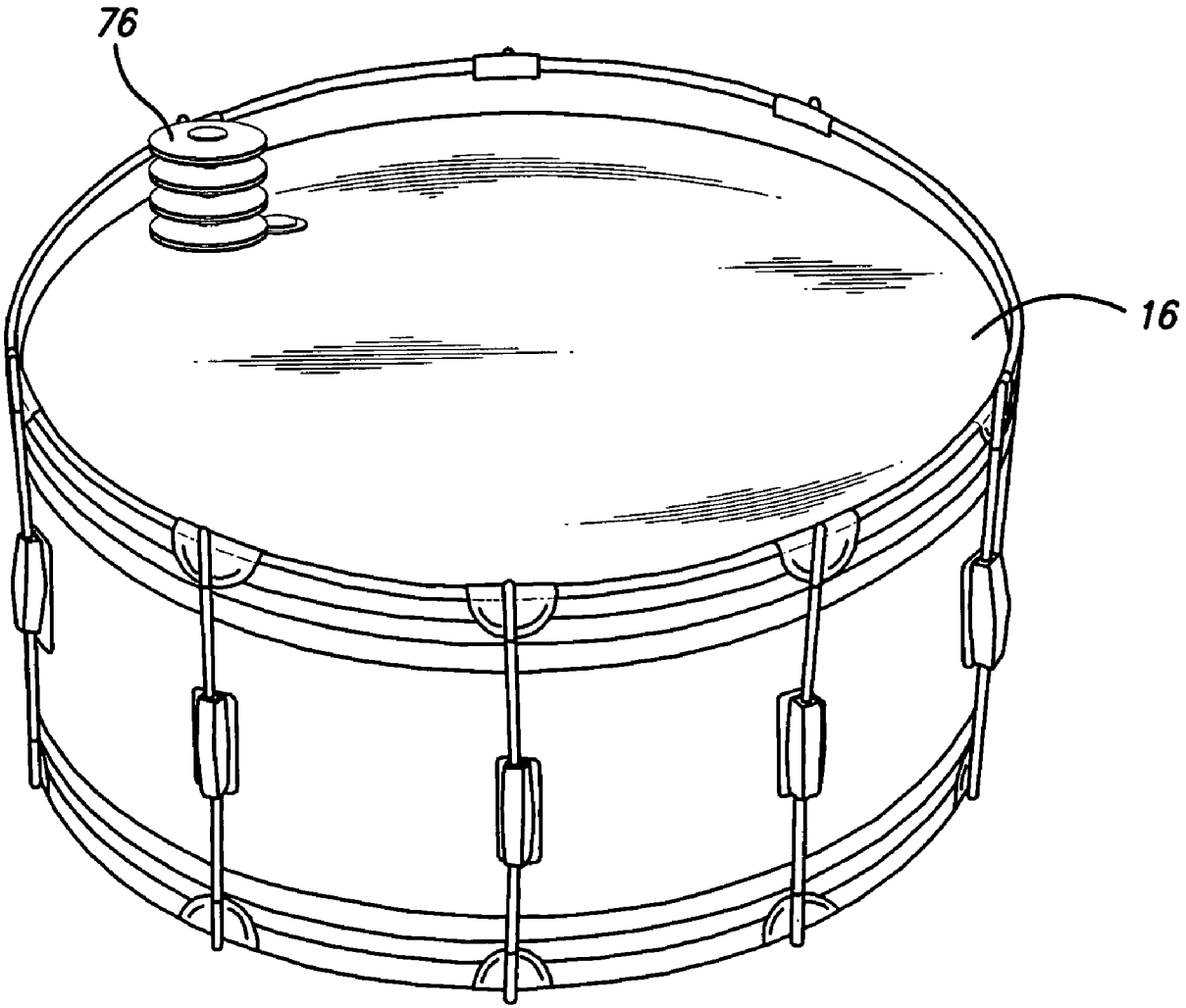
FIG. 5 is a perspective view of a second alternative embodiment of the improved sound modification system in accordance with the present invention.
Figure 6:
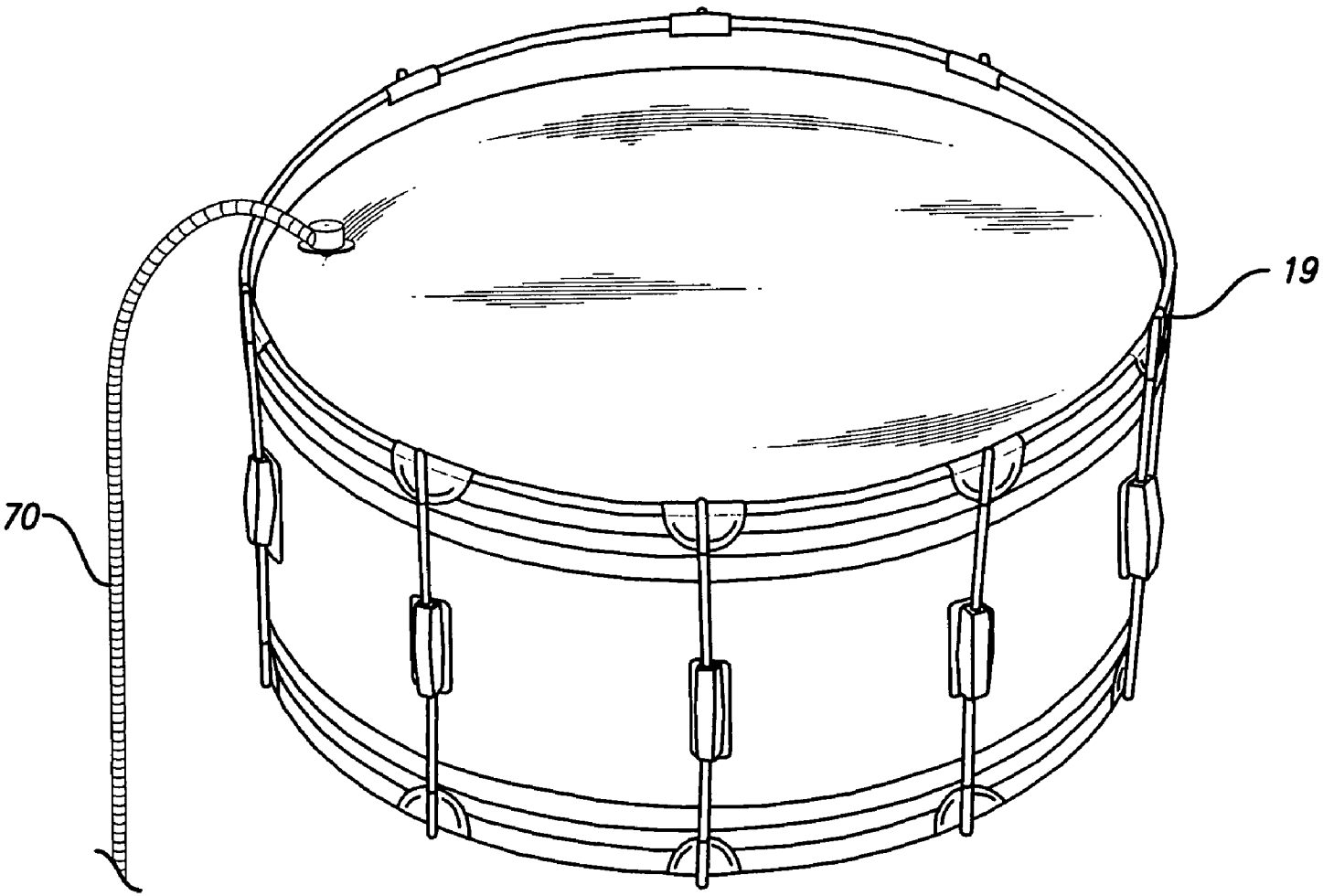
FIG. 6 is a perspective view of a third alternative embodiment of the improved sound modification system in accordance with the present invention.
Figure 7:
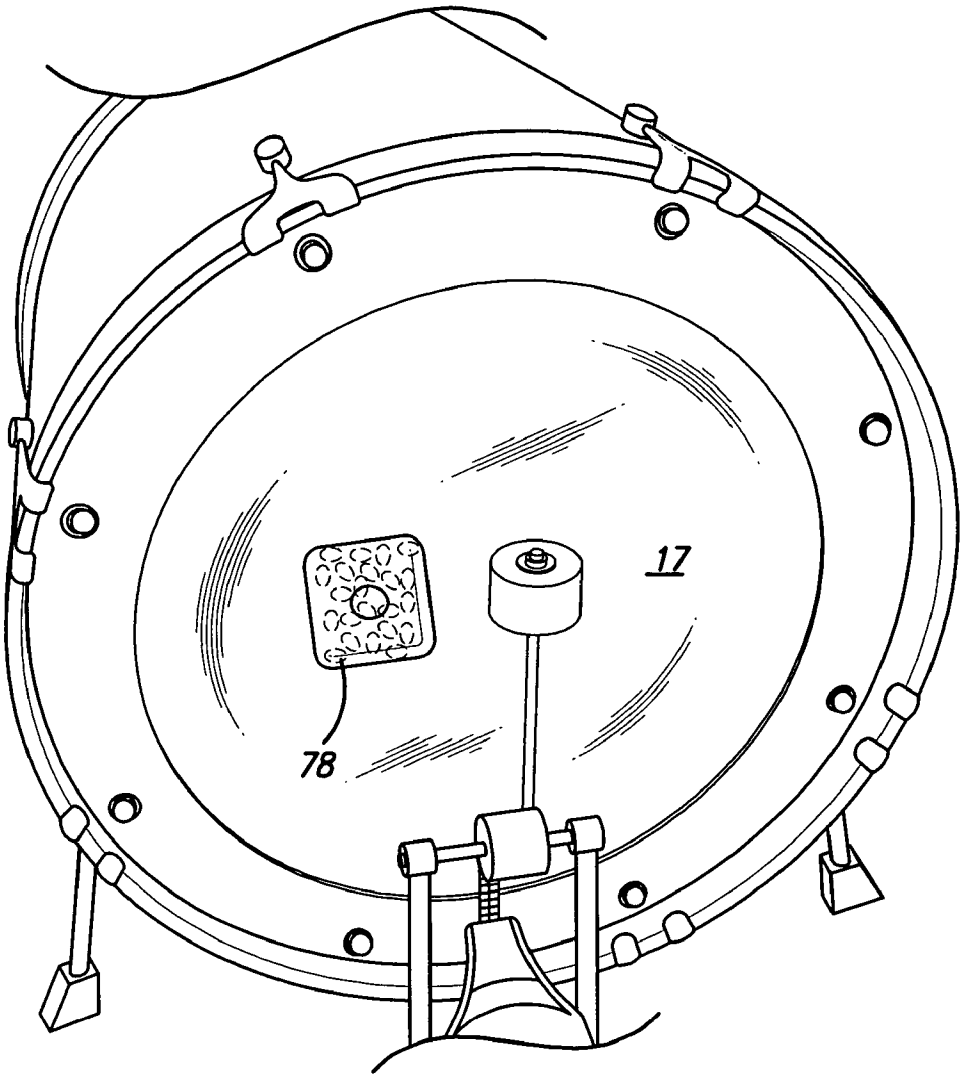
FIG. 7 is a perspective view of a fourth alternative embodiment of the improved sound modification system in accordance with the present invention.
Figure 8:
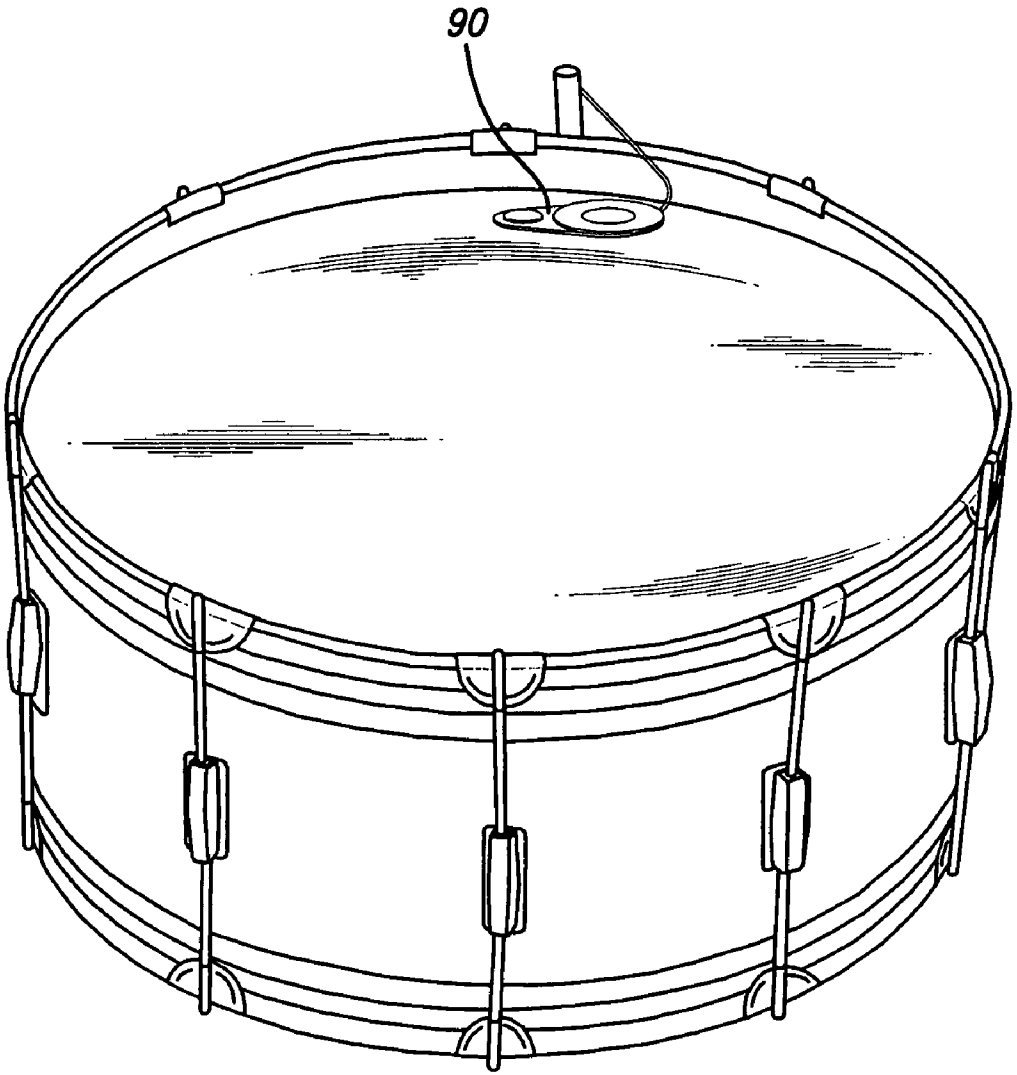
FIG. 8 is a perspective view of a fifth alternative embodiment of the improved sound modification system in accordance with the present invention.
Figure 9:
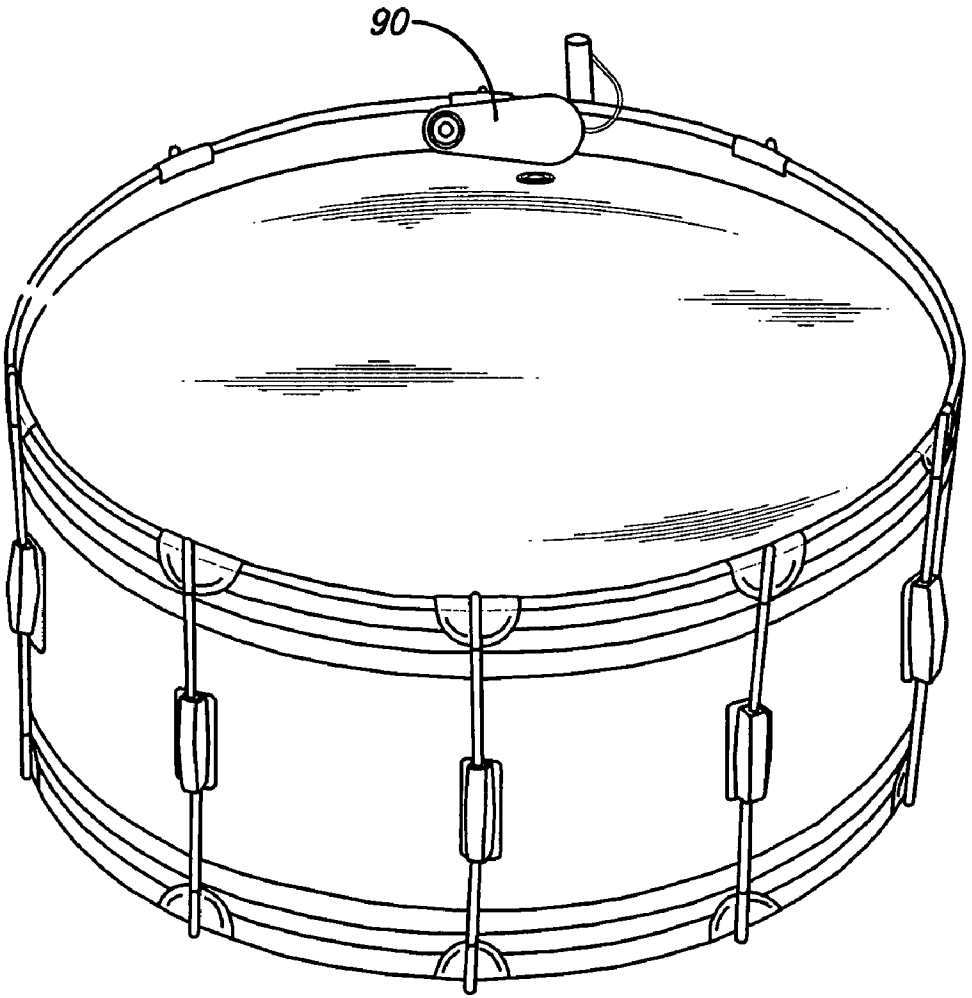
FIG. 9 is a perspective view of the fifth alternative embodiment of the improved sound modification system in accordance with the present invention shown separated from the drumhead membrane.

Snap fasteners 26, 28 can also be used to attach jingles 76 to head 16 (FIG. 5), coiled wire spring 70 to membrane 17 of a tom-tom 19 (FIG. 6) and a shaker 78 to membrane 17 (FIG. 7).

In all these cases, the instrument is given the ability to produce a variety of unique sounds, by interchanging or even combing different sound altering elements employing the system of the present invention.

Another embodiment of the system of the present invention involves the use of snap fasteners 26, 28 with piezo transducers 90 employed with electronic drums (not shown). Electronic drums operate by attaching piezo transducer 90, either to the drum rim or to the drum shell supported by some kind of external bracket. This alternative embodiment of the system of the present invention uses snap fastener 28, which is attached to transducer 90. Transducer 90, with attached fastener 28, is then mated with snap fastener 26 riveted into the drumhead. Upon impact on the head, an electrical signal is triggered and transmitted to a sound module (not shown), which manifests the unique or altered sound. Plastic and mesh drumheads are most appropriate for use with this particular embodiment of the present invention.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A sound modification system for a musical drum comprising a drumshell, a drumhead with an inner surface and an outer surface, the sound modification system comprising:

one or more mounting members adapted to be affixed to said drumhead, each of said mounting members having a first coupling member fixedly projecting outwardly from said outer surface and a second coupling member matable to said first coupling member; and, a sound altering element adapted to removably engage said drumhead, said sound altering element having means cooperable with said matable first and second coupling members to form a joined detachable connection between said sound altering element and said drumhead.

2. A sound modification system for a musical drum comprising a drumshell, a drumhead with an inside surface and an outer surface, the sound modification system comprising:

a sound altering element adapted to be removably mounted on said outer surface; and, means to snap-fasten said sound altering element to said outer surface.

3. The sound modification system as recited in claim 2 wherein said sound altering element has a plurality of openings adapted to detachably receive said means to snap-fasten said sound altering element to said outer surface.

4. The sound modification system as recited in claim 2 wherein said snap-fasten means comprises one or more first snap members adapted to be affixed to and project from said outer surface and one or more second snap members, each of said second snap members being matable to a corresponding said first snap member.

5. The sound modification system as recited in claim 3 wherein each of said openings conforms to receive corresponding said first and second snap members in snapping engagement.

6. The sound modification system in claim 5 wherein each said second snap member includes a flange portion that spans and covers at least a portion of the interior rim of each said opening.

7. The sound modification system as recited in claim 6 wherein said sound altering element is loosely secured between one or more of said mated first and second snap members.

8. The sound modification system as recited in claim 1 wherein said sound altering element has a hoop-like configuration.

9. The sound modification system as recited in claim 1 wherein said sound altering element is comprised of a resilient synthetic material.

10. The sound modification system as recited in claim 1 wherein said sound altering element is comprised of a foam material.

11. The sound modification system as recited in claim 1 wherein said sound altering element is comprised of a resilient synthetic base with a foam backing.

12. The sound modification system as recited in claim 2 wherein said sound altering element comprises a spring.

13. The sound modification system as recited in claim 2 wherein said sound altering element comprises an elongated spring.

14. The sound modification system as recited in claim 2 wherein said sound altering element comprises a musical shaker.

15. The sound modification system as recited in claim 2 wherein said sound modification system comprises a plurality fo musical jingles.

16. A sound modification system for a musical drum comprising a drumshell, a drumhead with an inner surface and an outer surface, the sound modification system comprising:

one or more mounting members adapted to be affixed to said drumhead, each of said mounting members having a first coupling member fixedly projecting outwardly from said outer surface and a second coupling member matable to said first coupling member;

a sound altering element adapted to removably engage said drumhead;

a transducer cooperable with said matable first and second coupling members to trigger an electrical signal to a sound module; and means cooperable with said matable first and second coupling members to form a joined detachable connection between said sound altering element and said drumhead.

* * * * *